US009416976B1

(12) United States Patent
Oatis

(10) Patent No.: US 9,416,976 B1
(45) Date of Patent: Aug. 16, 2016

(54) ASADOR TOOL

(71) Applicant: William Douglas Oatis, Silver Creek, MS (US)

(72) Inventor: William Douglas Oatis, Silver Creek, MS (US)

( * ) Notice: Subject to any disclaimer, the term of this patent is extended or adjusted under 35 U.S.C. 154(b) by 0 days.

(21) Appl. No.: 14/683,111

(22) Filed: Apr. 9, 2015

(51) Int. Cl.
*F24B 15/00* (2006.01)

(52) U.S. Cl.
CPC ..... *F24B 15/002* (2013.01)

(58) Field of Classification Search
CPC ..... F24B 15/00; F24B 15/002; F24B 15/10; A47J 37/0786; F23J 1/04; B25J 1/04; A47F 13/06
USPC ..... 294/9, 10, 14, 23, 24, 182; 7/109
See application file for complete search history.

(56) References Cited

U.S. PATENT DOCUMENTS 269,767 A * 12/1882 Wilson ..... B25J 15/0616 126/220
366,369 A * 7/1887 Bierman ..... B25J 1/04 294/23
457,219 A * 8/1891 Sanford ..... B25J 1/04 125/36
3,888,535 A * 6/1975 Rosso ..... A62C 33/00 294/175
D248,209 S 6/1978 Holleman
4,176,871 A * 12/1979 Stover ..... F24B 15/10 294/10
D267,999 S 2/1983 Rhoades
6,959,951 B2 * 11/2005 Amodeo ..... A47J 45/10 294/10
7,131,675 B1 11/2006 Loucks
8,162,361 B2 4/2012 Biddington

FOREIGN PATENT DOCUMENTS

GB 371568 * 4/1932

* cited by examiner

*Primary Examiner* — Dean Kramer
(74) *Attorney, Agent, or Firm* — William C. West

(57) ABSTRACT

An asador tool is provided having an ember scraper, a top front push fork, and two legs mounted on an elongated shaft with a tip point. Each leg has a rear pull point and a bottom front push point. The tip point is designed to penetrate and break up burning wood. The ember scraper having a plurality of scraper points forming a top saw tooth edge is designed to scrape hot embers from the surface of burning wood to expose the fire to new fuel. The top front push fork with a plurality of top front push points is mounted on a shaft top surface, and the two legs are mounted on a shaft bottom surface. The rear pull points and the push points are designed to pull and push, respectively, burning wood to create airflow and position the wood exactly where the Asador desires.

13 Claims, 9 Drawing Sheets

8/9

ASADOR TOOL

FIELD OF THE INVENTION

The invention relates to an asador tool. In particular, the invention relates to asador tools that are designed to allow for easier manipulation of the fuel of a fire.

BACKGROUND OF THE INVENTION

Asador is a Spanish noun used to describe a professional who cooks with natural hardwood and fire; usually a fire on the ground. In North America, this type of person would be considered a 'grillmaster' or 'pitmaster', although they typically use charcoal or lump wood coal. The asador tool is the workhorse of the Asador and his ground fire. Most people will informally refer to it as a poker. It is the most misunderstood and unappreciated piece of equipment because there has never been a commercially designed tool as the present invention built for the Asador to use for his culinary ground fire. Most people believe that a poker has only one use: to "poke" at burning wood. Give the average person a poker and tell them to "man the fire" and they will poke at the fire all night. However, give it to an experienced Asador and you will be impressed as he employs it with skill and knowledge. Below are the six detailed uses of the Asador poker.

Use #1: The Creation of Airflow. The Asador needs a balance of oxygen, heat and fuel in order for his fire to burn to its fullest potential. This is where the asador tool proves its worth. As wood burns, it naturally "settles," or collapses towards the base of the fire. When this happens, it is common for two or more pieces of wood to "fall" in parallel, basically side by side or on top of each other, thus minimizing oxygen flow to as much as 30% of its surface space. Moreover, when the wood settles and lays flat on top of the coals beneath it, the wood surface in contact with coals is starved of oxygen and drops in temperature. This is not as big a concern when using irregular-shaped wood that will not lay flat. However, it is a big deal when using split wood that has two to three flat sides. An Asador instinctively knows this and uses his poker to reposition the wood and create airflow so the wood is not laying in parallel contact with each other, nor directly on top of the coal base.

Use #2: The Initial Reorganization of the Fire. The initial shape of a cooking fire is not properly organized for cooking. When discussing the cooking fire, the "front side" of the fire is the closest to the actual food preparation area on the periphery of the fire, which is where some of the coals to support the cooking process will be harvested. The "back side" of the fire is on the opposite of the "front side" and is where additional wood is added for fuel. Using the present invention, the Asador can more efficiently physically separate the burning wood from the coals and establish the "front side" and the "back side" of a fire making the fire ready for cooking.

Use #3: Dislodging Glowing Embers. When fire consumes wood, its exterior, the surface exposed to the fire, eventually turns into embers that glow bright red while still attached to the surface of the wood. These attached embers essentially starve the fresh wood fuel that is beneath it, thus stagnating the fire. Sometimes, especially with smaller pieces of wood, these embers naturally release from the wood and fall into the fire. When this happens, fresh fuel in the form of wood is exposed to the fire and burns hot. Sometimes, embers that form on bigger pieces of wood need to be dislodged from the wood and the present invention is designed to do this.

Use #4: Promote the Even Burning of Wood. The most intense, hottest part of any fire is its center, which is sometimes referred to as the core. When wood is added to the fire, the pieces closest to the center are consumed faster than those along the peripheral of the fire. The asador tool should be ideally designed to reposition the wood around in order to promote even consumption.

Use #5: Make Way for New Wood. When a fire is built, it is only a matter of time before the original pieces of wood fuel are consumed and no longer produce heat. The Asador's job is to ensure the fire has a continuous supply of fuel by adding more wood. In most cases, he can lay wood on the fire without rearranging it. However, sometimes he has to move a couple pieces of wood around in order to make way for bigger pieces.

Use #6: Reposition Wood in Order to Safely Harvest Coals. The last use for the asador tool is to reposition the wood, so that using a shovel the Asador can harvest the coals. After reorganizing the fire, the Asador usually harvests the coals from the front side of the fire. However, when the front side's supply has been depleted, the Asador needs to move the wood around on the back side of the fire so that he can use the shovel to harvest more coal.

Most fire pokers generally fall into two categories: manufactured and improvised. Ironically, poker designs have changed very little over the last couple hundred years. They're basically heavy metal rods approximately 30-36 inches (76-92 centimeters) in length with blunt tips and a stubby hook off to one side. Over the years, numerous designs have been manufactured and/or improvised from existing designs with varying degrees of frustration. There are two issues with using the traditional poker design for the Asador's ground fire. First, most are designed for use in the indoor fireplace and are too short for the outdoor ground fire. As a result, they don't provide enough "stand off" from the intense heat of a mature ground fire, and you can get burned. The length is acceptable for a weak burning waist-level live-fire, but is insufficient for many applications. Second, the traditional design does not safely satisfy the above six requirements, specifically when it comes to moving wood around. Even the fireman's pike is inadequate. It's a longer version of a poker [usually 6 feet (1.8 meters)] designed to check the structural integrity of a roof to a burning house before a fireman walks on it. Although its length makes it more desirable than a traditional fireplace poker, its unwieldy size makes it inefficient for the Asador's use. The second category, the improvised poker, is exactly as it sounds, anything that can be used to poke at the fire. This can be a stick, a metal pipe or a garden hoe. Obviously, an improvised poker is better than using your hands but, like the traditional design, it's at best an undesirable substitute. The present invention satisfies the above six requirements and provides a device ideally suited for the Asador.

A fire poker (also known as a "stoker") is a short, rigid rod, preferably of fireproof material, used to adjust coals and/or wood fuel, burning in a fireplace or a fire pit. It is often metallic and sometimes has a point at one end for pushing burning materials (or a hook for pulling/raking, or a combination thereof) and a poker handle at the opposite end. An example of a fire poker as found in the prior art can be seen in U.S. Pat. No. 7,131,675 This fire poker has a hook portion attached at one end of a shaft, with a handle at the opposing end. This poker has a straight segment that extends past the hook portion by about one inch, this distance is not significant enough to allow for the straight segment to be utilized for stoking a fire without having the hook portion interfere with the process and the hook will not provide for delicate displacement of material (e.g. logs) used to fuel the fire often allowing the wood to slip or turn on the hook. U.S. Pat. No. 8,162,361 illustrates a fireplace poker that has an elongate shaft with a hook member disposed near the very end of the shaft. At the opposing end, there is a loop member. The shaft has a bend located between the loop hand grip and the pointed end of the shaft. The hook member may provide less efficiency when manipulating the delicate displacement of material (e.g. logs) used to fuel the fire. Materials may easily spin and slip off the hook. Additionally, the loop shaped hand grip and the bend in the shaft may make the positioning of materials difficult in the direction of the pointed end of the poker. U.S. Design Pat. No. 267,999 illustrates a fire poker that has an elongate shaft. One end of the shaft has what appears to be a wooden handle attached thereto. The opposing end of the shaft is curled around to form a hook member. At the same end of the shaft, but on the side opposing the hook member, another hook member extends from the shaft in a direction opposing the first hook member. U.S. Design Pat. No. 248,209 shows poker having an elongate shaft with a wooden grip one end and a single hooking and pushing member on the opposing end. Materials being pushed or pulled can spin and slide off of the pokers in U.S. Design Pat. Nos. 267,999 and 248,209. This makes it difficult to place materials on the fire. Additionally, none of the prior art patents provide a means to scrape the burning material surface to expose new fuel to the fire or do the prior art patents provide an effective means to push and pull the materials, such as logs, reducing the likelihood that the log or other material will turn and slip before the material's desired position in the fire is obtained. Finally, none of the prior art patents provide a means to physically "spear" and penetrate the wood so that the heaviest of logs can be safely picked up and strategically placed on any part of the fire in a controlled manner, instead the prior art patents appear to rely on instruments having a more "blunted" end to probe the fire. The prior art patents are for designs that solely manipulate a fire of an indoor fireplace, and they are not for devices that are very useful to the Asador as he manipulates an outdoor ground fire.

SUMMARY OF THE INVENTION

It is an object of the present invention to provide an asador tool which addresses the deficiencies as found in the prior art.

An asador tool is provided comprising: a generally elongated shaft having a rear end and a tip point, a handle adapted to co-operate with the shaft using a collar attached to the rear end of the shaft and facilitate the manipulation and control thereof; the handle being disposed in the general vicinity of the collar that is attached to the rear end of the shaft; a structure which is adapted, shaped and dimensioned so as to facilitate the control and maintenance of the fire and selected arrangement of components thereof, the structure being adapted which is comprised of an elongated shaft having a tip portion and a rear portion. The shaft rear portion has a cross section that is constant from a rear end to the beginning of the tip portion and the tip portion narrows from the uniform cross section of the rear portion to a tip point. The tip is designed to penetrate a few millimeters into wood (in a spear-like motion) so it can be strategically moved exactly where the Asador desires and to bust up partially consumed burning wood pieces so the under-consumed ends can be returned to the center of the fire. Holding the shaft horizontally, a horizontal plane running through a longitudinal axis that runs from the shaft rear end to the tip point divides the shaft surface into a shaft top surface and a shaft bottom surface. The shaft is designed to add heft to the tool so when the Asador uses it in a spear-like motion, it has the energy to bust up and penetrate burning wood. A collar may be attached to the rear portion of the shaft and a handle connected to the collar extending the length of the asador tool. A top front push fork with a plurality of top front push points, an ember scraper with a top saw tooth edge, a first leg and a second leg each having a bottom front push point and a rear pull point may be attached to the shaft. The front top push points are designed to maneuver under and push burning wood forward to create airflow, which oxygenates and intensifies the fire. In addition to pushing the burning wood forward to create airflow, the bottom push points give the Asador the capability to position the wood, especially surface wood, exactly where the Asador desires. The rear pull points are designed to pull burning wood to the rear to create airflow and give an additional capability to position the wood. The ember scraper is designed to scrape hot embers from the surface of burning wood to expose the fire to new fuel. The front top push points, the rear pull points and the bottom front push points having the angled "V" shape allowing effective contact with the material being manipulated.

In addition to the top saw tooth edge, the ember scraper has a fork aperture, a shaft aperture and a first mount key and a second mount key. The shaft is inserted through the shaft aperture in the ember scraper and the ember scraper positioned on the shaft rear portion just to rear of the shaft tip portion. The first and second mount keys are designed to cooperate with a first leg key and a second leg key, respectively, allowing the first leg and the second leg to be easily positioned and attached to the shaft. The top front push fork has a handle on one end and a fork portion with the top front push points on an other end. The fork aperture of the ember scraper is sized to receive the handle portion of the top front push fork. The top front push fork is mounted to the shaft by inserting the handle portion through the fork aperture of the ember scraper so that the top push points are positioned forward and up, and the fork portion is adjacent to an ember scraper front face. A rear weld edge of the handle portion may be welded to the shaft securing the top front push fork to the shaft. Preferably, the cross section of the shaft rear portion of the asador tool is circular but could also be a square, a rectangular, a triangular, or an elliptical cross section with the front top portion narrowing to the tip point. It is also preferred that the asador tool is made of boron or round cold rolled steel.

BRIEF DESCRIPTION OF THE DRAWINGS

The present invention will be described in detail with reference to the Drawings in which.

DETAILED DESCRIPTION OF THE INVENTION

Figure 4:
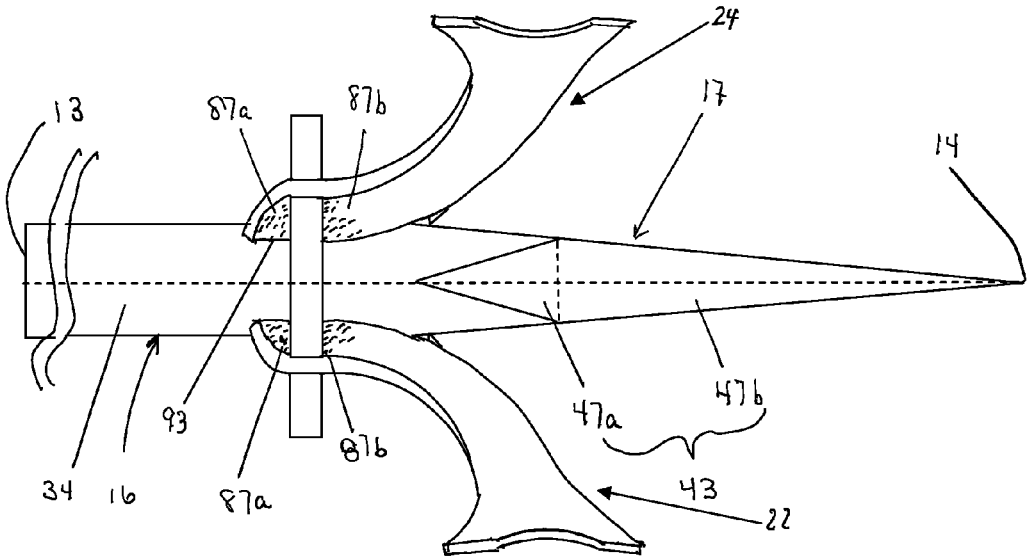
FIG. 4 is a bottom plan view of an aspect of the present invention
Figure 5:
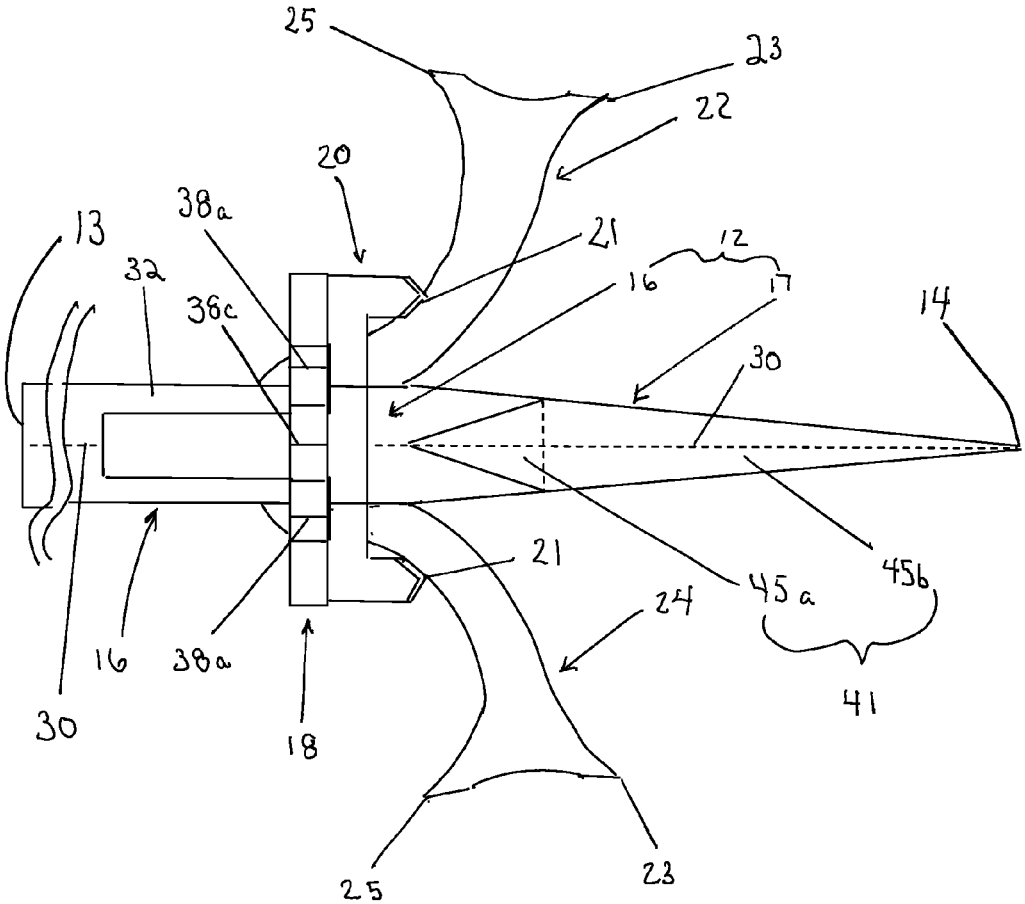
FIG. 5 is a top plan view of an aspect of the present invention

In describing the invention like parts are identified with the same number. Looking again at FIGS. 1, 2, and 3, the asador tool 10 comprises a shaft 12, an ember scraper 18, a top front push fork 20, a first leg 22, a second leg 24, a tool handle 26, and a collar 28. The shaft 12 comprising a shaft rear portion 16 and a shaft tip portion 17. The shaft 12 has a rear end 13 and a tip point 14. The shaft rear portion 16 has a uniform cross section and the shaft 12 has a longitudinal axis 30 running from the rear end 13 to the tip point 14. The shaft rear portion 16 is located between the rear end 13 of the shaft 12 and the shaft tip portion 17, and the shaft tip portion 17 is located between the shaft rear portion 16 and the tip point 14. Looking at FIG. 2, a side elevation view of the asador tool 10, the shaft tip portion 17 narrows down from the shaft rear portion 16 to the tip point 14. Looking at FIG. 3 a frontal view of the asador tool 10, the shaft tip portion 17 has a plurality of faces, such as first face 41, in a predetermined tip portion configuration. The preferred predetermined tip point configuration comprises a plurality of faces, the first face 41, a second face 42, a third face 43, and a fourth face 44 with the first face 41, the second face 42, the third face 43, and the fourth face 44 each being generally flat and equally spaced around the longitudinal axis 30 of the shaft 12, and each having a triangular rear face portion, such as triangular first rear portion 45*a*, and each having a triangular front face portion, such as triangular first front portion 45*b*, and the triangular first rear portion 45*a* and the triangular first front portion 45*b* each having the same base, such a first base 45*c*; and the triangular first front portion 45*b*, the second front portion 46*b*, the third front portion 47*b*, and the fourth front portion 48*b* forming a pyramid shaped nose portion 49 narrowing down to the tip point 14. FIG. 4 is a bottom plan view of the shaft 12 showing the third face 43. FIG. 5 is a top plan view of the shaft 12 of the asador tool 10 showing the first face 41.

As used in the specification as well as in the appended claims, the terms "about" is utilized to modify various numerical values. In this context, the term "about" should be construed to mean any value that is within 10% of the stated value. For example, if the term "about" is used to modify a value of 20°, then the value should then be interpreted as representing the range of 18° to 22°, that is, the value +/−10%. The term "somewhat" when to used to modify the terms "smaller" and "larger" means 0.5 mm smaller or larger, respectively. Looking at FIGS. 2-5 when as used in the specification as well as in the appended claims the terms "up", "down", "left", "right", "top", "bottom", "front", "forward", "rear", "inner", and "outer" are referenced with the shaft 12 of the preferred embodiment 10 of the present invention having the longitudinal axis 30 positioned in a horizontal position with a horizontal axis plane running through the longitudinal axis 30 and dividing the shaft 12 into a top half having a shaft top surface 32 and a bottom half having a shaft bottom surface 34. The shaft 12 is an elongated element. Looking again at FIG. 1, the term "front" is used to mean facing or toward the end of the shaft 12 with the tip point 14. The term "forward" means in the general direction that the tip point 14 is pointing. The term "rear" means the end of the shaft 12 with the rear end 13. Looking again at FIG. 5, a plan view of the shaft top surface 32, the terms "left" and "right" describe orientations when an individual is facing the rear end 13 of the shaft 12, and the individual is looking to the tip point 14. Looking at FIG. 3, the term "inner" means a component generally facing or closer to a vertical axis plane 31, the vertical axis plane 31 running through and along the longitudinal axis 30 and perpendicular to the horizontal axis plane, than a similar "outer" component that is facing or farther away from the vertical axis plane 31.

Figure 1:
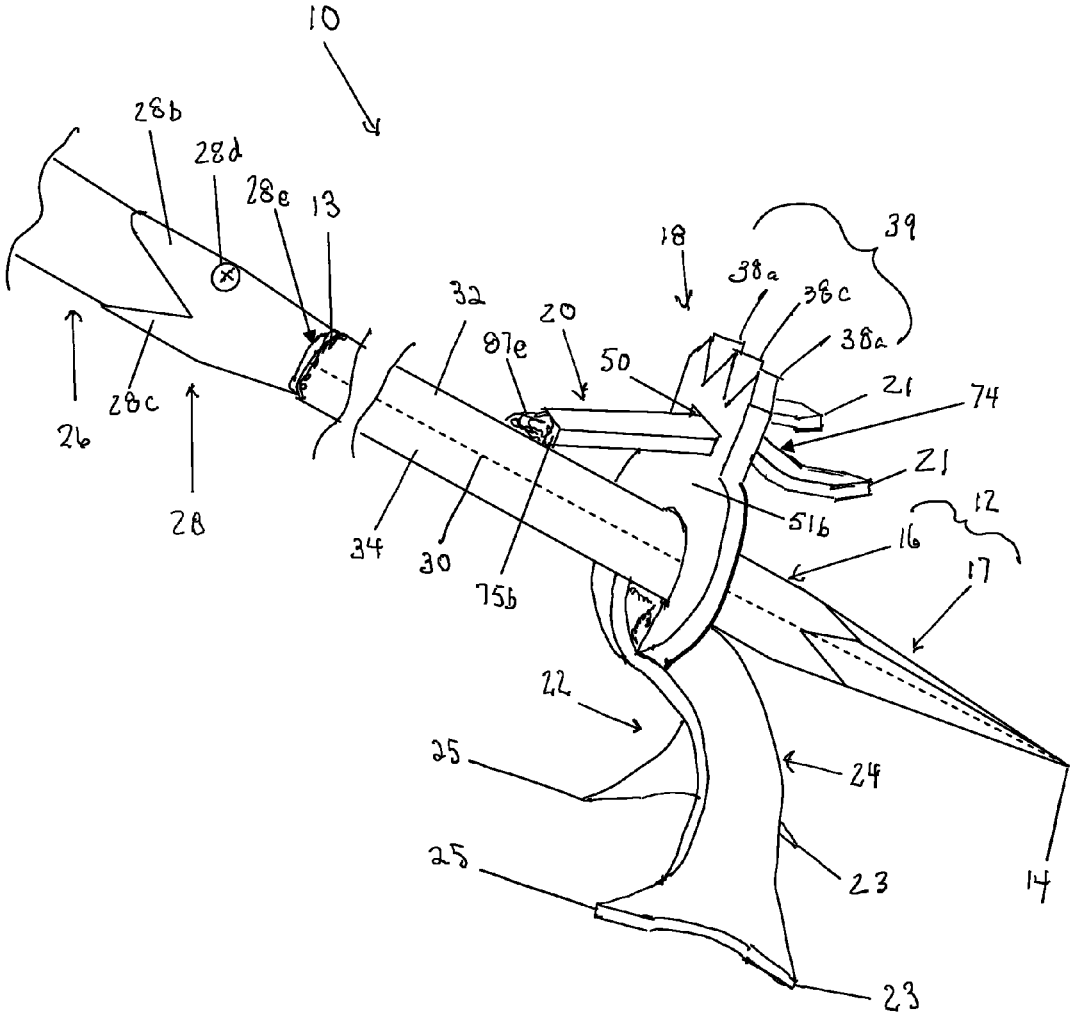
FIG. 1 is a perspective view of the present invention
Figure 2:
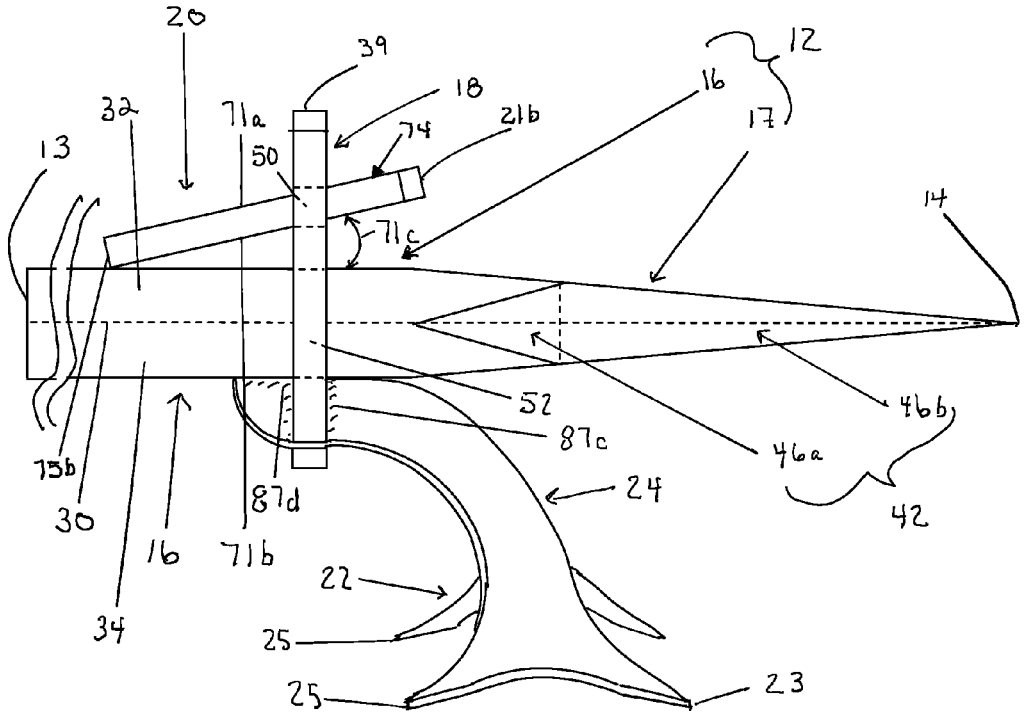
FIG. 2 is a side elevation view of an aspect of the present invention

Referring to FIGS. 1 and 2, the ember scraper 18 has a push fork aperture 50 for the positioning of the top front push fork 20. Looking at FIG. 2, the ember scraper 18 has a shaft aperture 52, and the shaft 12 is inserted into the shaft aperture 52 so that the ember scraper 18 is mounted on the shaft rear portion 16 just to the rear of the shaft tip portion 17 and perpendicular to the longitudinal axis 30 of the shaft 12. Looking again at FIG. 1, the ember scraper 18 has a plurality of scraper points, such as a first outside scraper point 38*a*, a second outside scraper point 38*a*, and an inner scraper point 38*c*, positioned above the shaft top surface 32 and pointed away from the shaft 12.

Figure 9:
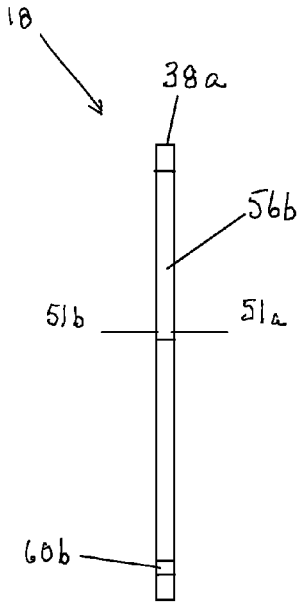
FIG. 9 is a side elevation view of the ember scraper of the present invention

Referring to FIGS. 1, 6, 7 and 8, the ember scraper 18 may have a predetermined scraper point configuration with at least the first outside scraper point 38*a*, the second outside scraper point 38*a*, the inner scraper point 38*c*, the push fork aperture 50, and the shaft aperture 52. Referring to FIGS. 1, 6, 7 and 8, the ember scraper 18 may be a plate, and the first outside scraper point 38*a*, the second outside scraper point 38*a* and the inner scraper point 38*c* may form a top saw tooth edge 39. The ember scraper 18 is designed to scrape hot embers from the surface of burning wood to expose the fire to new fuel. Referring to FIGS. 1 and 2, and more particularly FIGS. 8 and 9, in the predetermined ember scraper configuration, the ember scraper 18 may have a front ember scraper face 51*a* and a rear ember scraper face 51*b*, and the ember scraper 18 may comprise a scraper portion 19*a* and a mount portion 19*b* separated by a dashed divide plane 19*c*. The scraper portion 19*a* extends from the mount portion 19*b*, and the scraper portion 19*a* has the push fork aperture 50, and the mount portion 19*b* has the shaft aperture 52. Looking at FIG. 8, the top saw tooth edge 39 is located between a first outside scraper edge 56*a* and a second outside scraper edge 56*b*. The first outside scraper edge 56*a* is parallel to the second outside scraper edge 56*b*. The mount portion 19*b* has a first mount edge 59*a* and a second mount edge 59*b* with the first mount edge 59*a* located between the first outside scraper edge 56*a* and the second mount edge 59*b*, and the second mount edge 59*b* located between the first mount edge 59*a* and the second outside scraper edge 56*b*. The mount portion 19*b* portion also has a first mount key 60*a* and a second mount key 60*b* sized to insert the first leg 22 and the second leg 24, respectively. The push fork aperture 50 is centered between the first outside scraper edge 56*a* and the second outside scraper edge 56*b* and the push fork aperture 50 is sized and located so that the top front push fork 20 may be inserted in the push fork aperture 50 and the top front push fork 20 may have a predetermined fork angle 71*c* between 15 and 70 degrees, preferably 40 degrees, with the shaft top surface 32 when the ember scraper 18 is mounted to the shaft 12.

Figure 3:
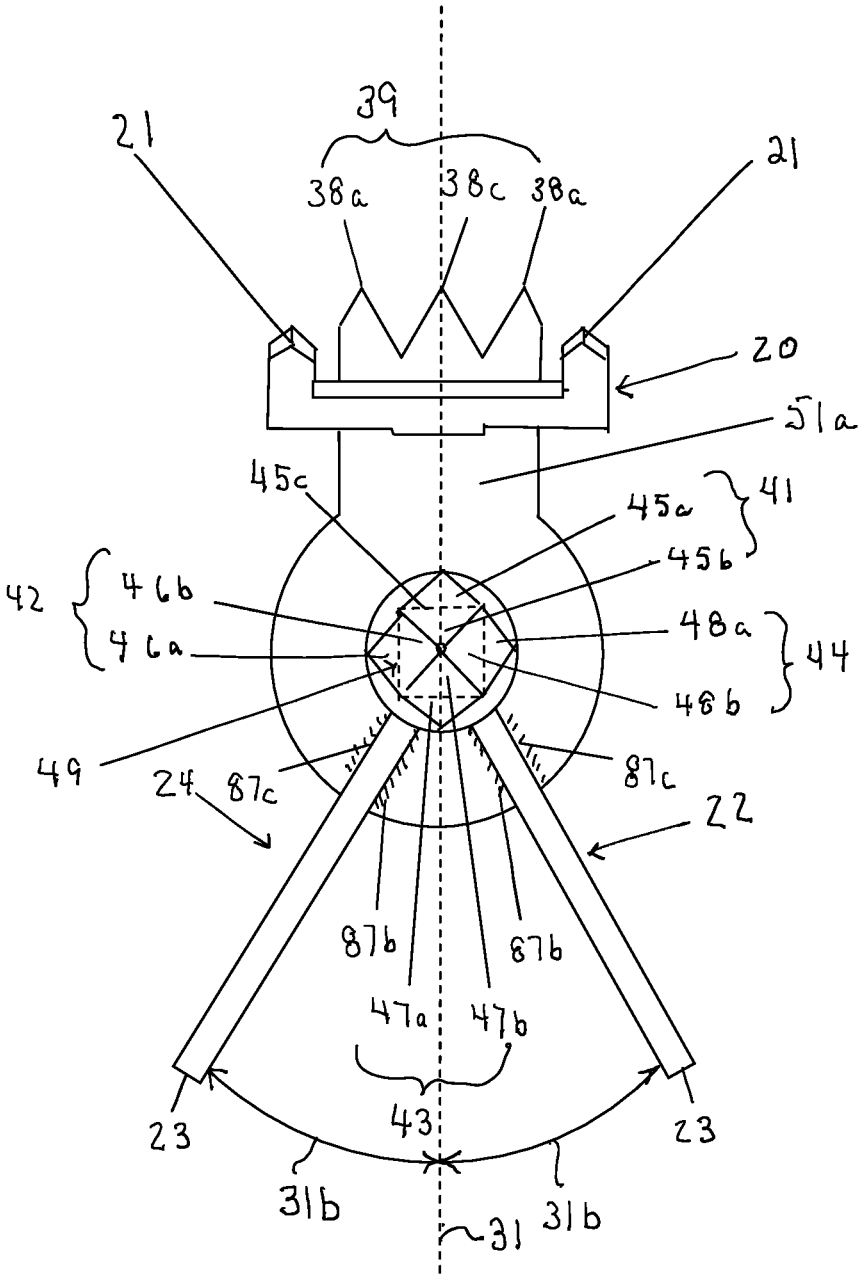
FIG. 3 is a front view of an aspect of the present invention
Figure 6:
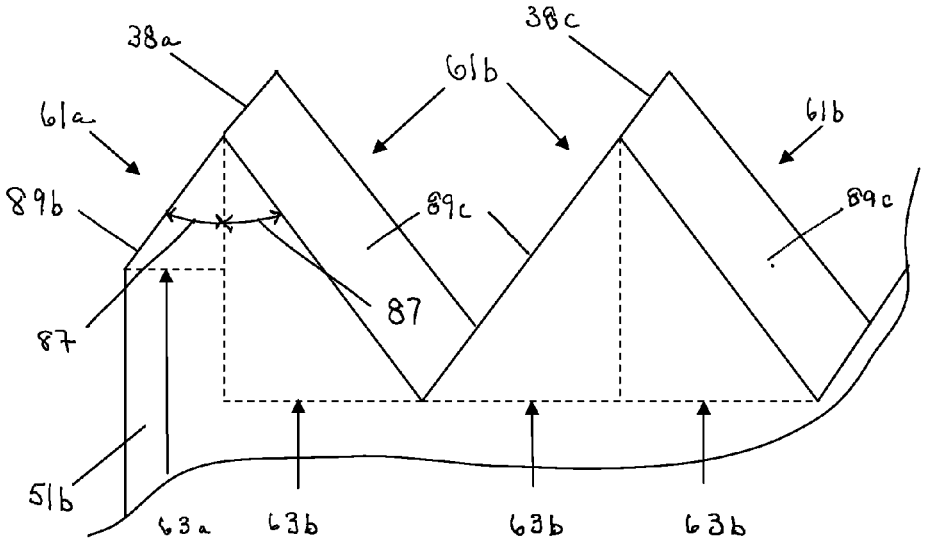
FIG. 6 is a left top prospective view of an ember scraper first and second scraper points
Figure 7:
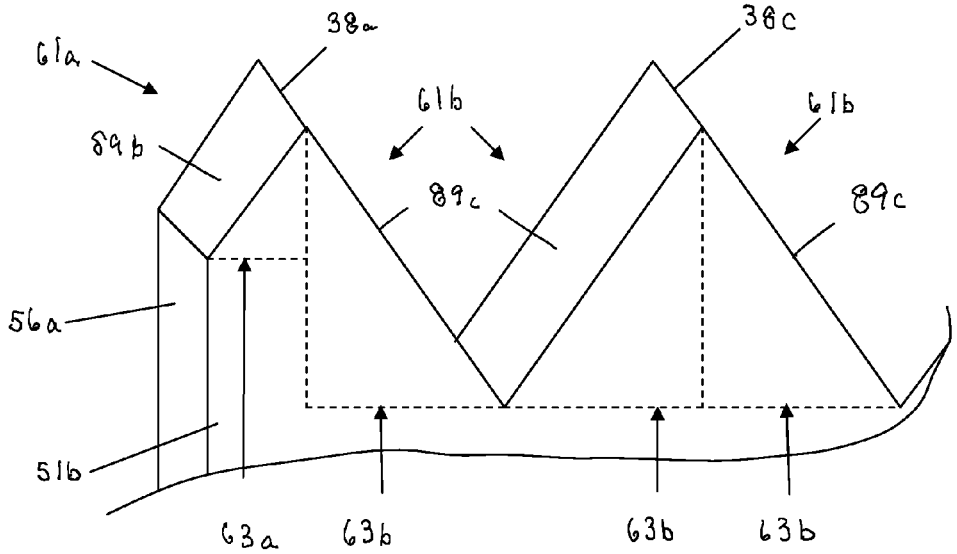
FIG. 7 is a right top prospective view of the ember scraper first and second scraper points
Figure 8:
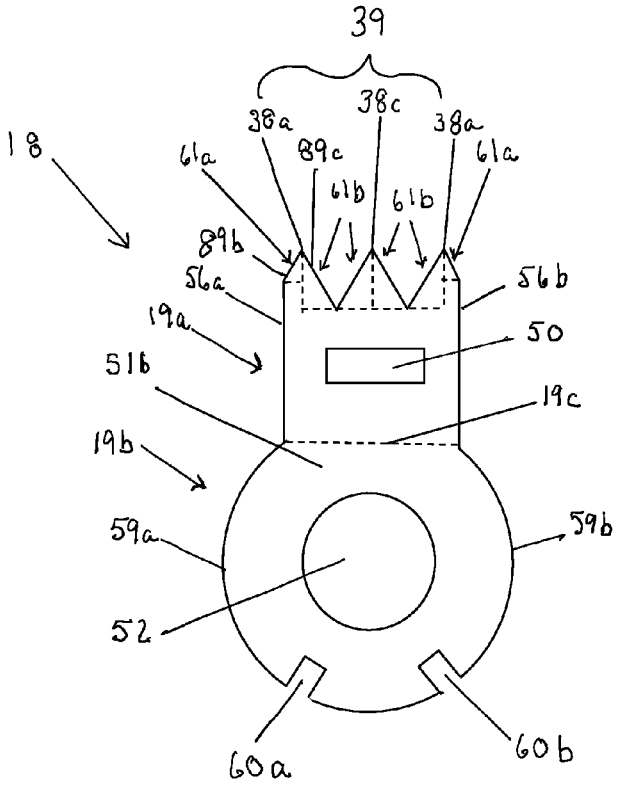
FIG. 8 is an elevation view of the ember scraper of the present invention

Looking at FIGS. 3, 6 and 7, the first outside scraper point 38*a* may be formed by a triangular first prism 61*a* and a triangular second prism 61*b* placed back to back. Similarly the second outside scraper point 38*a* may be formed. The triangular first prism 61*a* and a triangular second prism 61*b* may have the same apex angle 87. The triangular first prism 61*a* and the triangular second prism 61*b* have a right triangular first base 63*a* and a right triangular second base 63*b*, respectively. The triangular first prism 61*a* has an exposed first face 89*b* and the triangular second prism 61*b* has an exposed second face 89*c* with the exposed first face 89*b* and the exposed second face 89*c* intersecting to form the first outside scraper point 38*a*. Inner scraper point 38*c* may be formed by placing two prisms, similar to the triangular second prism 61*b*, back to back so that exposed faces, such as exposed second face 89*c*, intersect to form the inner scraper point 38*c*. The base of the right triangular first base 63*a* is half the base of the right triangular second base 63*b*, preferably 0.3 cm. The scraper portion 19*a* having a push fork aperture 50 is sized to pass through a fork handle portion 72 of the top front push fork 20.

Figure 10:
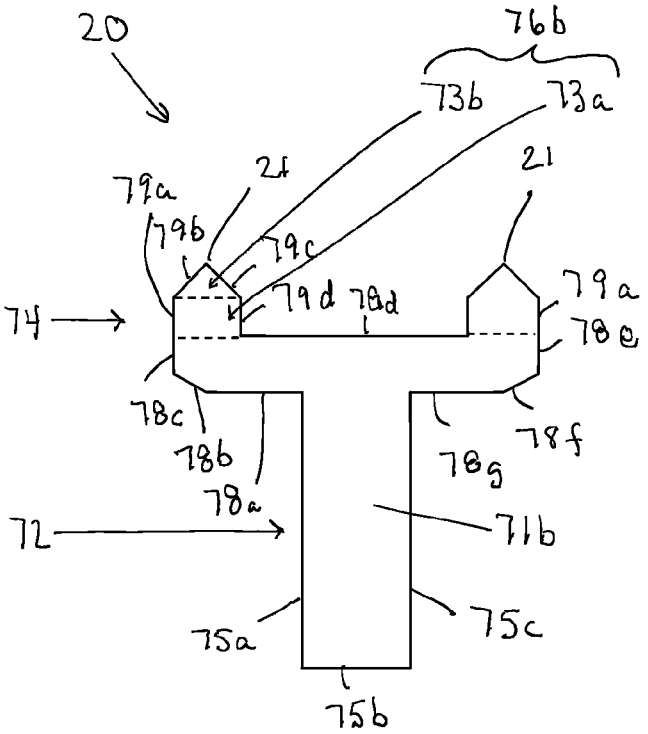
FIG. 10 is an elevation view of the top front push fork of the present invention
Figure 11:
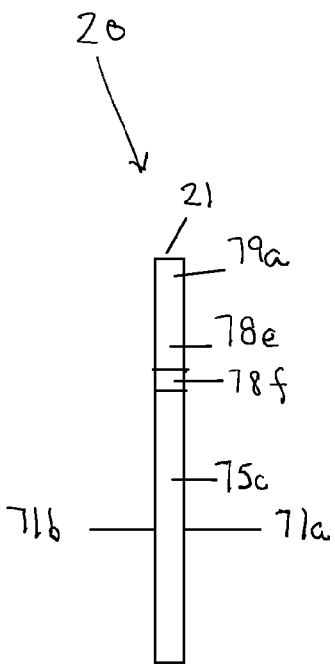
FIG. 11 is a side elevation view of the top front push fork of the present invention

Looking at FIGS. 10 and 11, the top front push fork 20 may have a predetermined top front push fork configuration. The predetermined push fork configuration for the top front push fork 20 may be a plate having a top front push fork first face 71*a* parallel and aligned to a top front push fork second face 71*b*, with the top front push fork first face 71*a* and the top front push fork second face 71*b* shaped like a fork, the top front push fork 20 comprised of a fork handle portion 72 and a fork upper portion 74. The fork handle portion 72 is generally rectangular and is located on the rear of the top front push fork 20, and has a fork handle weld edge 75*b* located between a fork handle first outside edge 75*a* and a fork handle second outside edge 75*c*. The fork upper portion 74 has a fork first corner 78*b* located between a fork first rear edge 78*a* and a fork first outside edge 78*c*; the fork first rear edge 78*a* is located between the fork first corner 78*b* and the fork handle first outside edge 75*a*. The fork upper portion 74 has a plurality of tines, such as a first tine 76*b*, with the first tine 76*b* extending up and forward to the left of a fork front edge 78*d*; the first tine 76*b* having a rectangular first tine base portion 73*a* with a first tine outer edge 79*a* and a first tine inner edge 79*d*, and a first tine push portion 73*b* that is a triangular prism, said first tine push portion 73*b* having a first tine outer face 79*b* and a first tine inner face 79*c* intersecting to form a first top front push point 21, said first tine outer face 79*b* located between the first tine inner face 79*c* and the first tine outside edge 79*a*; said first tine inner edge 79*d* located between the first tine outer face 79*c* and the fork front edge 78*d*. Similarly, a second top front push point 21, identical to the first top front push point 21, may be formed opposite the first top front push point 21 to the right of the fork front edge 78*d*. The top front push fork 20 has a fork second outside edge 78*e* located between the second tine outside edge 79*a* and a fork second corner 78*f*, and the fork second corner 78*f* located between a fork second outside edge 78*e* and the fork second rear edge 78*g*; said fork handle second outside edge 75*c* located between the fork second rear edge 78*g* and the fork handle weld edge 75*b*, the fork handle first outside edge 75*a* located between the fork handle weld edge 75*b* and the fork first rear edge 78*a*. The first tine push portion 73*b* may be formed similar to the inner scraper point 38*c* shown in FIGS. 6 & 7.

Looking again at FIGS. 1 and 2, the push fork aperture 50 is sized to insert the top front push fork 20 so that the fork handle weld edge 75*b* of the top front push fork 20 is touching the shaft top surface 32 and the fork upper portion 74 is adjacent to the ember scraper 18, and looking particularly to FIG. 2, the top front push fork second face 71*b* has an predetermined fork angle 71*c* between 15 and 70 degrees, preferably 40 degrees with the shaft top surface 32. Looking again to FIG. 1, the top front push fork 20 is attached to the shaft 12 by fork handle fastening means 87*e*, fastening the fork handle weld edge 75*b* to the shaft top surface 32, preferably the fork handle fastening means 87*e* is a weld.

Figure 12:
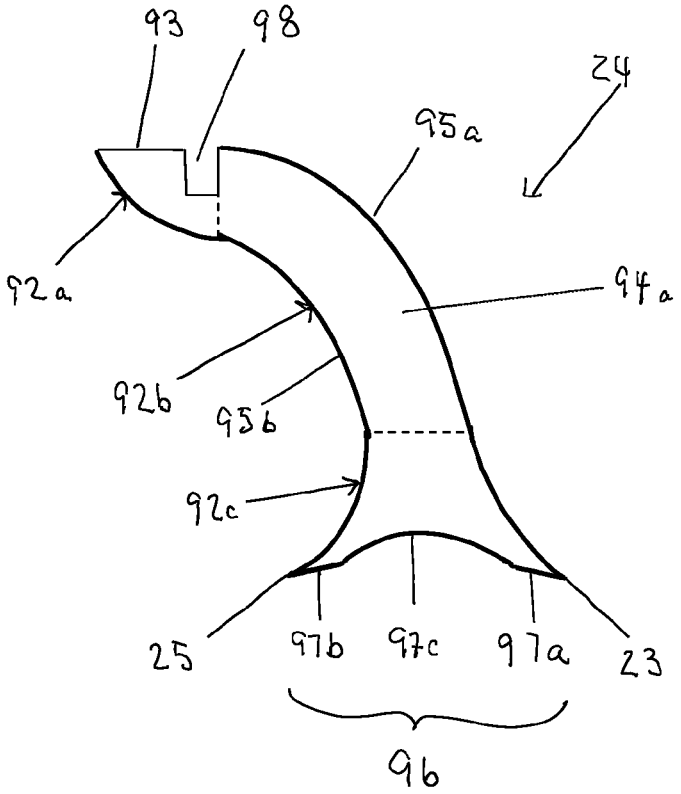
FIG. 12 is an elevation view of a second leg of the present invention
Figure 13:
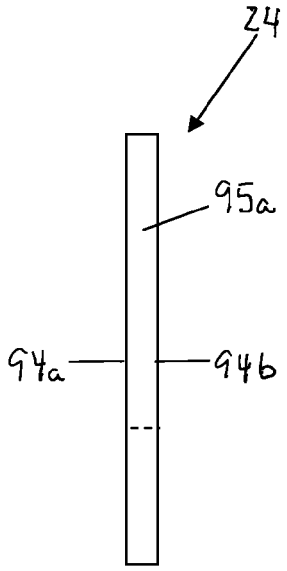
FIG. 13 is a leg front edge view of the second leg of the present invention

The first leg 22 and the second leg 24 are identical to each other and are of a predetermined leg configuration. The first leg 22 and the second leg 24 each may be a plate with a leg mid portion 92*b* of constant width, providing strength in tension and compression across the constant width of the leg mid portion 92*b*. For example, looking at the second leg 24 as to the predetermined leg configuration, the second leg 24 has a leg upper portion 92*a*, the leg mid portion 92*b*, and a leg lower portion 92*c*, with the second leg 24 having a leg shaft edge 93 between a leg key 98 and a leg rear edge 95*b*, the leg key 98 located between the leg shaft edge 93 and the leg front edge 95*a*, and the second leg 24 having a leg bottom edge 96 between the leg rear edge 95*b* and the leg front edge 95*a*; said leg bottom edge 96 comprised of a leg bottom center edge 97*c* that is concave and located between a leg bottom front edge 97*a* and a leg bottom rear edge 97*b*. The leg front edge 95*a* is connected to the leg bottom front edge 97*a* forming the bottom front push point 23, the leg bottom rear edge 97*b* connected to the leg rear edge 95*b* forming the rear pull point 25. The first leg 22 and the second leg 24 each have a leg key 98 in the leg upper portion 92*a*, and the leg key 98 is sized to be inserted in a mount key, such as the second mount key 60*b* of the mount portion 19*b* of the ember scraper 18 shown in FIG. 8. The first leg 22 and the second leg 24 are each mounted such that the leg shaft edge 93 of the leg upper portion 92*a* is adjacent to the shaft bottom surface 34 of shaft rear portion 16 as shown in FIG. 2 for the second leg 24. Referring again to FIG. 12, the leg rear edge 95*b* of the leg mid portion 92*b* is generally a quarter of a circle and concave with a radius of curvature between 3 and 6 cm, preferably 4 cm. The leg rear edge 95*b* of the leg upper portion 92*a* is convex and has a radius of curvature equal to the constant width of the leg mid portion 92*b*. Preferably, the leg mid portion 92*b* has a width of 2 cm. The leg front edge 95*a* of the leg mid portion 92*b* is generally a quarter of a circle and convex with a radius of curvature equal to the radius of curvature of the leg rear edge 95*b* of the leg mid portion 92*b* plus the width of the leg mid portion 92*b*. The leg front edge 95*a* of the leg lower portion 92*c* is concave and tapers from the leg mid portion 92*b* having a generally uniform width to a leg bottom edge 96 that is wider. The leg rear edge 95*b* of the leg lower portion 92*c* is concave and tapers from the uniform width of the leg mid portion 92*b* to the leg bottom edge 96 that is wider than the leg mid portion 92*b*. The leg bottom edge 96 measures preferably 4.6 cm from the bottom front push point 23, the rear pull point 25. The leg bottom front edge 97*a* and the leg bottom rear edge 97*b* each being preferably 1 cm long and inclined at a bottom angle 85 of 10 degrees from the horizontal plane and the leg bottom center edge 97*c* being concave and having a radius of curvature preferably of 5 cm. Looking at FIG. 3 the first leg 22 and the second leg 24 are each a predetermined leg angle 31*b* from a vertical axis plane 31 running along the longitudinal axis 30 of the shaft 12, preferably the predetermined leg angle 31*b* is 23 degrees;

The first leg 22 and the second leg 24 of the asador tool 10 are each attached to the shaft 12 and the mount portion 19*b* of the ember scraper 18 using the leg key 98 of each leg, such the leg key 98 of the second leg 24 shown in FIG. 12. For example, the second leg 24 is attached by inserting the leg key 98 into the second mount key 60*b* shown in FIG. 8 so that the leg shaft edge 93 is adjacent to the shaft bottom surface 34 as shown in FIG. 4 and held in place by a plurality of leg fasteners, such as a leg inner rear weld 87*a* and leg inner front weld 87*b* shown in FIG. 4, and a leg outer front weld 87*c* and a leg outer rear weld 87*d* shown in FIGS. 2 and 3, connecting the second leg 24 to the shaft rear portion 16 and the mount portion 19*b* of the ember scraper 18. The first leg 22 is connected to the shaft 12 in a similar manner.

The asador tool 10 can be molded or forged out of a variety of materials to be sturdy, and should not be flammable or combustible. The preferred materials of the shaft 12, the ember scraper 18, the top front push fork 20, the first leg 22, the second leg 24 and the collar 28 are cold rolled steels. The tool handle 26 may be made of materials that do not transmit heat to the extent of making it unusable or materials that are not resistant to heat and will easily deform. Preferably the tool handle 26 is made of a hardwood, such as oak. The tool handle 26 is generally circular, and has a hemispherical distal end and a flat end.

It is preferable that the asador tool 10 has a smooth finish. It is contemplated that the shaft 12 of the asador tool 10 could have a circular cross section, square cross section, a rectangular cross section, a triangular cross section, or an elliptical cross section. The preferred cross section for the shaft rear portion 16 is circular with the shaft tip portion 17 narrowing form the circular cross section of the shaft rear portion 16 to a square cross section to the tip point 14. However, any type of cross section of the asador tool 10 would fall within the scope of the present invention. Most preferably, the shaft rear portion 16 of the asador tool 10 is made from 2 cm round stock cold rolled steel.

In the preferred embodiment of the present invention shown in FIG. 1, it is envisioned that the shaft 12, the ember scraper 18, the top front push fork 20, the first leg 22, the second leg 24 and the collar 28 of the asador tool 10 be molded or forged in a single unitary construction, and the ember scraper 18, the top front push fork 20, the first leg 22, the second leg 24 and the collar 28 welded to the shaft 12 reducing the likelihood of fasteners (e.g., screws, bolt, and nuts) working loose while employing the tool.

The overall length of the asador tool 10 may vary depending on the requirement of the user but is preferably 1.92-2.2 meters, with the tool handle 26 preferably 1.52-1.83 m long with a preferable thickness of 2.8 cm. As measured along the longitudinal axis 30, the asador tool 10 has: a preferable length from the collar 28 to tip point 14 of 40 cm, a preferable length of the collar 28 of 12 cm, and a preferable length of the shaft 12 of 28 cm. The shaft 12 has a thickness of preferably 2 cm. A distance of 5 cm is preferred between the first top front push point 21 and the second top front push point 21, and a length of 3 cm for the top saw tooth edge 39 is preferred. The bottom front push point 23 and the rear pull point 25 on each leg, such as the first leg 22 and the second leg 24, are spaced from each other by a preferred distance of 4.6 cm. The bottom front push point 23 on the first leg 22 is separated from the bottom front push point 23 on the second leg 24 by a preferable distance of 7.75 cm. Looking it FIG. 1, the collar 28 has an upper "V" shaped surface 28*b* and a lower "V" shaped surface 28*c* on one end configured to insert the tool handle 26, and the collar 28 tapers down to the cross section of the rear end 13 of the shaft 12. The tool handle 26 is inserted between the upper "V" shaped surface 28*b* and a lower "V" shaped surface 28*c* and a tool handle fastening means 28*d*, such as a rivet or screw, preferably a screw, secures the upper "V" shaped surface 28*b* and the lower 'V" shaped surface 28*c* to the tool handle 26. The other end of the collar 28 is attached to the rear end 13 of the shaft rear portion 16 by a collar fastening means 28*e*, such as bolt, a screw, or a weld, preferably a weld.

Although preferable dimensions and locations are given for various components, such as the shaft 12, of the asador tool 10, any feasible dimension that allows the user to safely employ the tool and efficiently stoke the fire falls within the scope of the present invention. To this end, it is contemplated that the bottom front push point 23 of the first leg 22, the bottom front push point 23 of the second leg 24, the first top front push point 21 and the second top front push point 21 may be 6 to 25 cm from the tip point 14, preferably 17.5 cm. At this distance, when the user is working the fire with the tip point 14, the first leg 22, the second leg 24, the first top front push point 21, and the second top front push point 21 will be outside of a range where they will contact the fire.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An asador tool comprising a shaft, an ember scraper, a top front push fork, a first leg, and a second leg;

said shaft being generally an elongated element;

said shaft having a shaft rear portion and a shaft tip portion;

said shaft tip portion narrowing down from a cross section of the shaft rear portion to a tip point along a plurality of faces in a predetermined tip portion configuration;

said shaft rear portion having a rear end, a shaft top surface, and a shaft bottom surface;

said shaft having a longitudinal axis; said longitudinal axis running from the rear end to the tip point and centered along the shaft;

said ember scraper having a plurality of scraper points;

said first leg and said second leg each having a bottom front push point and a rear pull point;

said top front push fork having a fork handle portion and fork upper portion;

said fork upper portion having a plurality of top front push points;

said plurality of top front push points pointed away from the shaft top surface and directed forward.

2. The asador tool of claim 1 wherein the shaft is inserted in a shaft aperture of the ember scraper;

said ember scraper mounted perpendicular to the longitudinal axis of the shaft; and said ember scraper having the plurality of scraper points spaced from the longitudinal axis and above the shaft top surface and directed away from the shaft top surface.

3. The asador tool of claim 1 wherein the fork handle portion of the top front push fork is inserted in a push fork aperture of the ember scraper;

said fork handle portion having a fork handle weld edge; and said fork handle weld edge secured to the shaft top surface by a fork handle fastening means.

4. The asador tool of claim 1 wherein the top front push fork is at a predetermined fork angle with the shaft top surface.

5. The asador tool of claim 1 wherein said first leg and said second leg are attached to the shaft bottom surface and attached to the ember scraper by inserting a leg key of each of the first leg and the second leg into a first mount key and a second mount key, respectively, of the ember scraper so that a leg shaft edge of the each of the first leg and the second leg is adjacent to the shaft bottom surface;

said first leg and said second leg secured to the shaft and the ember scraper by a plurality of leg fasteners;

said first leg and said second leg disposed a predetermined leg angle from a vertical axis plane running along the longitudinal axis of the shaft;

said first leg and said second leg each having a leg bottom edge with the bottom front push point forward of the rear pull point; and said bottom front push point directed forward and said rear pull point directed to the rear.

6. The asador tool in claim 1 further comprising a collar and a tool handle;

said collar located between the tool handle and the rear end of the shaft rear portion;

said shaft rear portion located between the collar and the shaft tip portion; said collar joining the tool handle to the shaft rear portion;

said collar secured to the tool handle by a tool handle fastening means;

said collar secured to the rear end of the shaft rear portion by a collar fastening means.

7. An asador tool comprising a shaft, an ember scraper, a top front push fork, a first leg, and a second leg;

said shaft being generally an elongated element;

said shaft having a shaft rear portion and a shaft tip portion;

said shaft tip portion narrowing down from a cross section of the shaft rear portion to a tip point along a plurality of faces in a predetermined tip portion configuration;

said shaft rear portion having a rear end, a shaft top surface, and a shaft bottom surface;

said shaft having a longitudinal axis; said longitudinal axis running from the rear end to the tip point and centered along the shaft;

said ember scraper having a plurality of scraper points;

said first leg and said second leg each having a bottom front push point and a rear pull point;

said top front push fork having a fork handle portion and fork upper portion; said fork upper portion having a plurality of top front push points; said plurality of top front push points pointed away from the shaft top surface and directed forward;

said shaft inserted in a shaft aperture of the ember scraper and mounted so that the ember scraper is perpendicular to the longitudinal axis of the shaft; said ember scraper having the plurality of scraper points located above the shaft top surface and directed away from the shaft top surface;

said fork handle portion of the top front push fork inserted in a push fork aperture of the ember scraper and a fork handle weld edge of the fork handle portion secured to the shaft top surface by a fork handle fastening means;

said top front push fork is at a predetermined fork angle with the shaft top surface;

said first leg and said second leg attached to the shaft bottom surface and the ember scraper by inserting a leg key of each of the first leg and the second leg into a first mount key and a second mount key, respectively, of the ember scraper, so that a leg shaft edge of the each of the first leg and the second leg is adjacent to the shaft bottom surface;

said first leg and said second leg secured to the shaft and the ember scraper by a plurality of leg fasteners;

said first leg and said second leg disposed a predetermined leg angle from a vertical axis plane running along the longitudinal axis of the shaft;

said first leg and said second leg each having a leg bottom edge with the bottom front push point forward of the rear pull point; and said bottom front push point directed forward and said rear pull point directed to the rear.

8. The asador tool in claim 7 further comprising a collar and a tool handle;

said collar located between the tool handle and the rear end of the shaft rear portion;

said shaft rear portion located between the collar and the shaft tip portion; said collar joining the tool handle to the shaft rear portion; said collar secured to the tool handle by a tool handle fastening means; and said collar secured to the rear end of the shaft rear portion by a collar fastening means.

9. An asador tool comprising a shaft, an ember scraper, a top front push fork, a first leg, and a second leg;

said first leg being identical to said second leg;

said shaft further comprising a shaft rear portion and a shaft tip portion;

said shaft rear portion having a rear end, a shaft top surface, and a shaft bottom surface;

said shaft tip portion having a tip point;

said shaft tip portion running from the tip point to the shaft rear portion;

said shaft rear portion having a cross section that is constant, with the shaft rear portion having the rear end on one end and on a other end joining the shaft tip portion;

said shaft being generally an elongated element;

said shaft having a longitudinal axis; said longitudinal axis running from the rear end to the tip point and centered along the shaft;

said shaft tip portion narrowing down from the cross section of the shaft rear portion to the tip point along a plurality of faces in a predetermined tip portion configuration;

said top front push fork having a fork handle portion and fork upper portion;

said fork upper portion having a plurality of top front push points;

said plurality of top front push points pointed away from the shaft and forward;

said ember scraper comprising a mount portion and a scraper portion;

said mount portion comprising a shaft aperture, a first mount key and a second mount key;

said shaft aperture somewhat larger than the shaft rear portion;

said scraper portion comprising a plurality of scraper points and a push fork aperture;

said plurality of scraper points being in a predetermined scraper point configuration;

said shaft inserted into the shaft aperture so that the ember scraper is mounted on the shaft rear portion just to the rear of the shaft tip portion and the plurality of scraper points is positioned above the shaft top surface and pointed away from the shaft;

said ember scraper being perpendicular to the longitudinal axis of the shaft; said first leg and said second leg each having a bottom front push point, a rear pull point, and a leg key;

said bottom front push point, and said rear pull point being preferably an angled "V" shape;

said first mount key and said second mount key keyed for the leg key of the first leg and the leg key of the second leg, respectively;

said leg key of the first leg and said leg key of the second leg sized to fit the first mount key and the second mount key, respectively.

10. The asador tool in claim 9 wherein the plurality of scraper points has at least a first outside scraper point, a second outside scraper point and an inner scraper point; said plurality of scraper points forming a top saw tooth edge.

11. The asador tool in claim 9 wherein said fork handle portion is inserted through the push fork aperture of the ember scraper so that the top front push fork is inclined at a predetermined fork angle with the shaft top surface, and a fork handle weld edge of the fork handle portion is attached to the shaft top surface by a fork handle fastening means, and the fork upper portion is adjacent to the ember scraper, and the plurality of top front push points is pointed away from the shaft and forward.

12. The asador tool in claim 9 wherein said first leg and said second leg each comprise a leg upper portion, a leg mid portion and a leg lower portion;

said leg mid portion between the leg upper portion and the leg lower portion; said first leg and said second leg each having a leg shaft edge, a leg front edge, a leg bottom edge, and a leg rear edge;

said leg shaft edge of the leg upper portion located between the leg key that is adjacent to the leg front edge of the leg mid portion and the leg rear edge of the leg upper portion; said leg bottom edge between the leg front edge and the leg rear edge;

said leg lower portion having the bottom front push point and the rear pull point;

said bottom front push point formed by the leg bottom edge intersecting the leg front edge of the leg lower portion;

said rear pull point formed by the leg bottom edge intersecting the leg rear edge of the leg lower portion;

said leg mid portion having a constant width as measured from the leg front edge to the leg rear edge;

said leg rear edge of the leg upper portion having a radius of curvature equal to the constant width of the leg mid portion;

said leg front edge of the leg lower portion tapering from the constant width of the leg mid portion to the leg bottom edge of the leg lower portion;

said leg rear edge of the leg lower portion generally being concave and tapering from the constant width of the leg mid portion to the leg bottom edge of the leg lower portion;

said bottom front push point directed forward;

said rear pull point directed to the rear;

said first leg and said second leg secured to the shaft and the ember scraper by a plurality of leg fasteners.

13. The asador tool in claim 9 further comprising a collar and a tool handle;

said collar located between the tool handle and the shaft rear portion;

said shaft rear portion located between the collar and the shaft tip portion; said collar joining the tool handle to the shaft rear portion;

said collar secured to the tool handle by a tool handle fastening means; and said collar secured to the shaft rear portion by a collar fastening means.

* * * * *